US005918318A

United States Patent [19]

Jones

[11] Patent Number: 5,918,318

[45] Date of Patent: Jul. 6, 1999

[54] ATTACHMENT DEVICE FOR CLOTHING ITEMS

[75] Inventor: Hanns Franklin Jones, Kissimmee, Fla.

[73] Assignee: Viable Products, LLC, Orlando, Fla.

[21] Appl. No.: 09/065,696

[22] Filed: Apr. 24, 1998

[51] Int. Cl.[6] ..... A41B 11/00; A41F 1/00

[52] U.S. Cl. ..... 2/239; 2/912; 2/917; 2/160; 24/DIG. 24

[58] Field of Search ..... 2/239, 912, 919, 2/917, 910, 911, 920, 240, 160, 159; 24/DIG. 29, 442, 446, 450

[56] References Cited

U.S. PATENT DOCUMENTS

| | | | |
|---|---|---|---|
| 2,663,877 | 12/1953 | Bohman | 2/239 |
| 4,058,853 | 11/1977 | Boxer et al. | 2/239 |
| 4,165,555 | 8/1979 | Boxer et al. | 2/239 |
| 4,975,985 | 12/1990 | Stimpson | 2/115 |
| 5,038,413 | 8/1991 | Ursino | 2/239 |
| 5,321,855 | 6/1994 | Ciuffo | 2/239 |
| 5,357,660 | 10/1994 | Smith | 2/239 |
| 5,579,541 | 12/1996 | Christy et al. | 2/239 |
| 5,740,558 | 4/1998 | Messman | 2/239 |

*Primary Examiner*—Amy Vanatta
*Attorney, Agent, or Firm*—Holland & Knight LLP

[57] ABSTRACT

An attachment device for releasably securing first and second clothing items comprises a first tab and a second tab each including mating hook and loop fastening elements which are mounted to respective clothing items in an orientation wherein the hook and loop fastening elements of the first tab engage and releasably connect to the hook and loop fastening elements of the second tab such that forces tending to separate the first and second clothing items during laundering result in the application of a shear force to the connected tabs.

20 Claims, 3 Drawing Sheets

ATTACHMENT DEVICE FOR CLOTHING ITEMS

FIELD OF THE INVENTION

This invention relates to clothing items, and, more particularly, to an attachment device for releasably connecting pairs of clothing items such as socks and gloves so that they are not separated during laundering.

BACKGROUND OF THE INVENTION

Washable clothing items which come in pairs, such as socks and gloves, present a tedious chore for the individual responsible for doing the laundry. Many athletic socks and dress socks look virtually identical, but are made out of different fibers and the like, so that they do not feel the same when worn. Consequently, the person doing his or her individual or household laundry is faced with the task of matching up pairs of socks or gloves with one another when they come out of the dryer.

Many ways have been suggested to alleviate this problem, but all suffer from one limitation or another. For example, clips, pins and other items that pierce both socks or gloves of the pair have been proposed as a means of maintaining the clothing items together in the washer and dryer. Typically, these fasteners are not readily at hand when one places the socks in the dirty clothes, and therefore are not used. In addition to fasteners which pierce the clothing items, U.S. Pat. No. 3,688,348 to Klotz discloses external bands which can be wrapped around the leg portions of the socks to keep them together during washing. Again, the problem is availability of these bands where one discards the socks or gloves for laundering.

Recognizing that separate fasteners to interconnect the socks is not feasible, others have attempted to mount fastening elements directly to a portion of the socks or gloves so that mating pairs can be connected together when placed in the dirty clothes. For example, snaps or hook and eye fasteners have been mounted on sock pairs so that they can be interconnected prior to laundering. Fasteners of this type are typically metallic or otherwise stiff and unyielding, which can create localized stresses in the socks or gloves during the laundering process in the area(s) where such fasteners are mounted.

In turn, localized forces are developed which can tear the sock fabric in a relatively short period of time. Additionally, metallic and/or stiff fastening elements can be uncomfortable to the wearer of the item. Any discomfort felt against the skin by fastening the elements associated with socks or gloves is unacceptable.

Many of the disadvantages with the clothing item fastening elements noted above are addressed in U.S. Pat. No. 4,165,555 to Boxer et al. This patent discloses the use of strips or patches affixed to each sock or glove of a pair, wherein each patch consists of a section of hook fastening elements and another section of loop fastening elements. When the socks or gloves are being worn, the two sections of the patch on each sock are folded into engagement with one another so that the hook and loop fastening elements interconnect and are not exposed. When the socks are removed for laundering, the sections forming the tab of each sock are placed in an "open" position, i.e., disengaged from one another, and then the tab of one sock or glove is releasably interconnected with the tab of the other sock or glove thus connecting the hook fastening elements of one tab with the loop fastening elements of the other tab.

The use of hook and loop fastening elements disclosed in the Boxer et al. patent eliminates many of the problems experienced in the prior art. The tabs or patches which carry the hook and loop fastening elements are permanently affixed to the sock or glove pair and thus problems with separate fastening elements such as hooks, pins, bands and the like are eliminated. Additionally, hook and loop fastening elements do not create localized stresses in the same way as snaps or hooks, and do not detract from the comfort of the clothing item to any noticeable extent. Unfortunately, it has been found that the connection between the sock or glove pair created by the tabs disclosed in Boxer et al. is insufficient to maintain the clothing items in engagement with one another during the laundering process. The various cycles of conventional washing machines, and dryers, can create forces on the sock or glove pairs which readily separates the hook and loop fastening elements of the patches; in the orientation in which they are affixed to the glove or sock pairs as disclosed in Boxer et al.

SUMMARY OF THE INVENTION

It is therefore among the objectives of this invention to provide an attachment device for securing clothing items such as socks or gloves which avoid separation of the clothing items during laundering, which is comfortable to the wearer of the clothing item, which is inexpensive to fabricate and affix to the clothing item, and, which has a long useful life even under severe laundering conditions.

These objectives are accomplished in an attachment device for releasably securing first and second clothing items which comprises a first tab and a second tab each including mating hook and loop fastening elements which are mounted to respective clothing items in an orientation wherein the hook and loop fastening elements of the first tab engage and releasably connect to the hook and loop fastening elements of the second tab such that forces tending to separate the first and second clothing items during laundering result in the application of a shear force to the connected tabs.

This invention is predicated upon the concept of interconnecting two tabs mounted to mating clothing items, each carrying hook and loop fastening elements, in an orientation such that a shear force is imposed on the fastening elements instead of a force acting substantially perpendicular or normal thereto. This is achieved by the position of the tabs on the clothing items, and the fact that the same one of the hook and loop fastening elements carried by each tab is affixed to the clothing item itself.

In the presently preferred environment, each tab comprises a strip of material such as cloth or the like carrying one section of hook fastening elements and an adjacent section of loop fastening elements. The two sections of each tab are moveable between a closed position in which the hook and loop fastening elements engage one another, and an open position in which the fastening elements are apart. The tabs are mounted to a pair of socks, for example, such that if the section of one tab carrying the loop fastening elements is mounted to the leg portion of one sock, then the section carrying the loop fastening elements of the second tab is mounted to the leg portion of the second sock. Each of the tabs has a longitudinal axis, and each leg portion of the two socks also has a longitudinal axis. When mounted to the socks, the longitudinal axis of each tab is substantially parallel to the longitudinal axis of the leg portion of a respective sock.

When the socks are being worn, each tab is placed in the closed position so that the hook and loop fastening elements on each section of the tab connect with one another and are not exposed. In order to launder the socks, the tabs are moved to the open position exposing the hook and loop fastening elements on each section. The tabs are then interconnected such that the hook fastening elements of one tab connect to the loop fastening elements of the other tab and visa-versa. Because the same type of fastening elements on each tab are mounted to the leg portion of the sock, when the tabs are connected to one another the socks are oriented end to end i.e., with leg portion of one sock essentially abutting the leg portion of the other sock. With the two socks in this orientation, forces imposed during the laundering process tending to pull the socks apart results in the application of a shear force to the connected tabs, i.e., a force acting generally parallel to the plane of the connected tabs. It has been found that hook and loop fastening elements are much stronger and more resistant to forces applied thereto in shear or parallel to such fastening elements, as distinguished from forces acting perpendicular to the interconnected hook and loop fastening elements.

In the Boxer et al. attachment device, depicted in FIG. 1 of the drawings, the tabs or patches 10 and 12 carrying the hook and loop fastening elements each have a longitudinal axis 14, 16, respectively, which is oriented generally perpendicular to the respective longitudinal axis 18, 20 of the leg portion of the socks to which they are affixed. With the tabs or patches in this orientation, the two socks are positioned substantially parallel to one another when the patches carried by each sock are connected together in preparation for laundering. Forces applied to the socks during the laundering operation tend to pill the socks directly apart from one another, thus imposing a force on the interconnected tabs or patches which acts substantially perpendicular thereto. The hook and loop fastening elements carried by such patches are easily separated from one another in response to the application of a normal force. Consequently, the socks are relatively easily separated during the laundering process when the attachment arrangement disclosed in Boxer et al. is employed.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
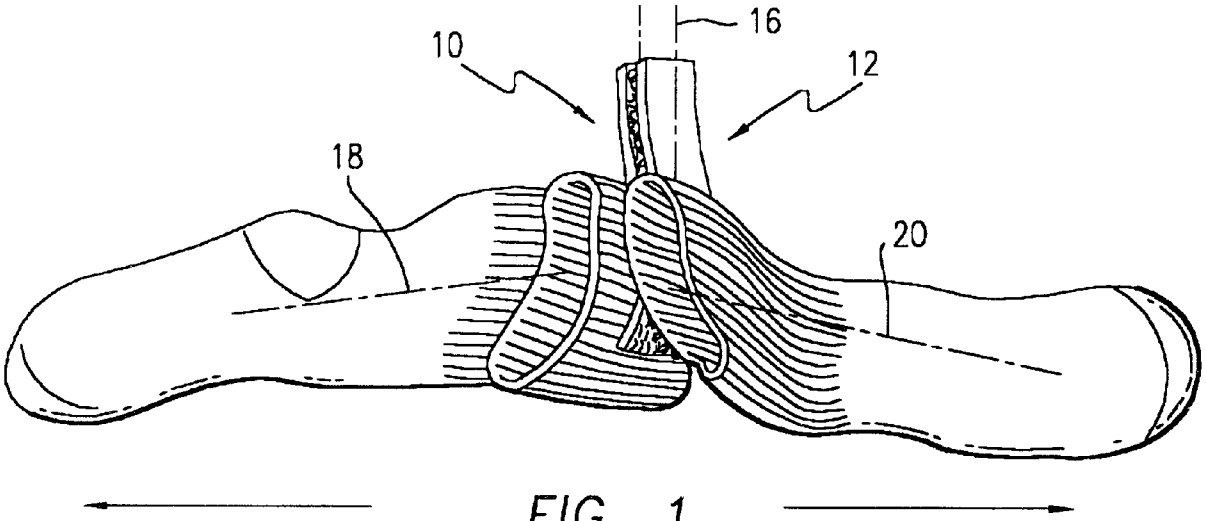
FIG. 1 PRIOR ART
FIG. 1 is a perspective view of a prior art attachment device disclosed in U.S. Pat. No. 4,165,555 to Boxer et al.

Referring now to FIGS. 2–6, the attachment device 22 of this invention is illustrated in detail. For purposes of the present discussion, the attachment device 22 is described in detail with reference to a pair of socks 24 and 26, although it should be understood that this invention is applicable to other pairs of clothing items such as the gloves 28, 30 shown in FIG. 7.

The attachment device 22 comprises a pair of tabs 32 and 34 each consisting of a strip of material such as cloth or the like. The tab 32 consists of one section 36 of hook fastening elements and an adjacent section 38 of loop fastening elements both carried on one side of the strip. Similarly, the tab 34 includes adjacent sections 40 and 42 of hook fastening elements and loop fastening elements, respectively, on the same side of the strip forming tab 34. Each of the tabs 32, 34 is movable between an open position depicted in FIG. 2, and a closed position shown in FIG. 6. In the closed position, the sections 26, 38 of tab 32, or sections 40, 42 of tab 34, are placed in engagement with one another revealing an "indicia" 44 on the exposed surface of the strip forming tabs 32, 34. This indicia 44 can be a logo, design, word(s), or essentially any other indicia.

Figure 2:
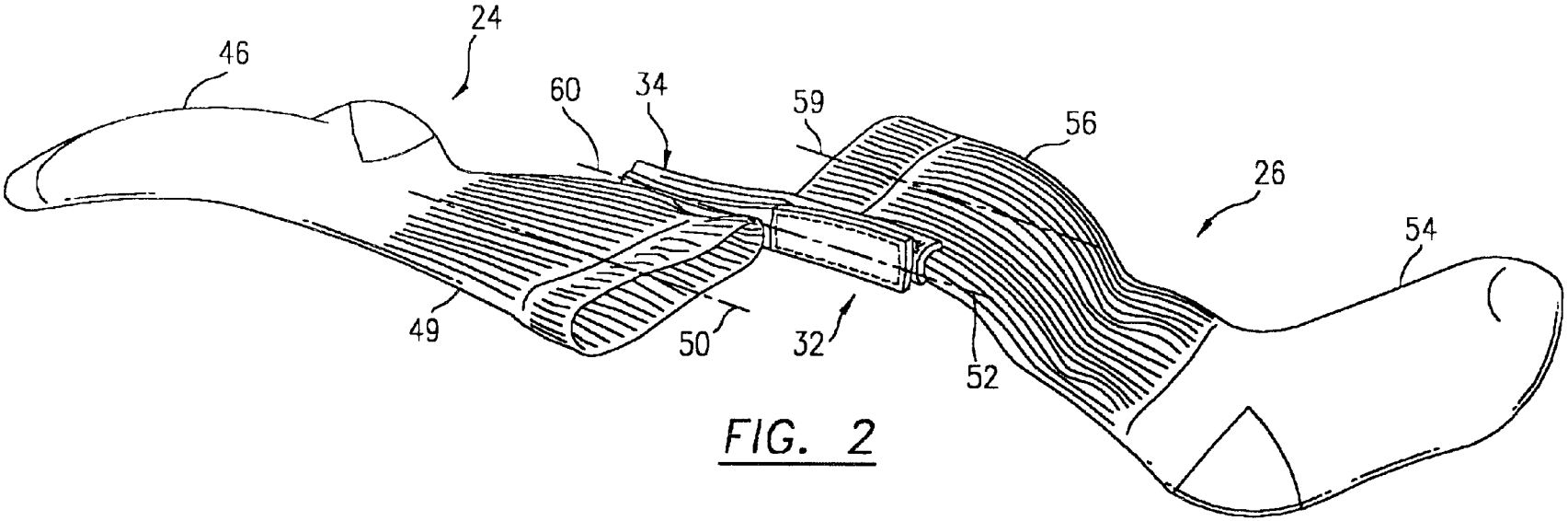
FIG. 2 is a perspective view of a pair of socks with the attachment device of this invention.
Figure 3:
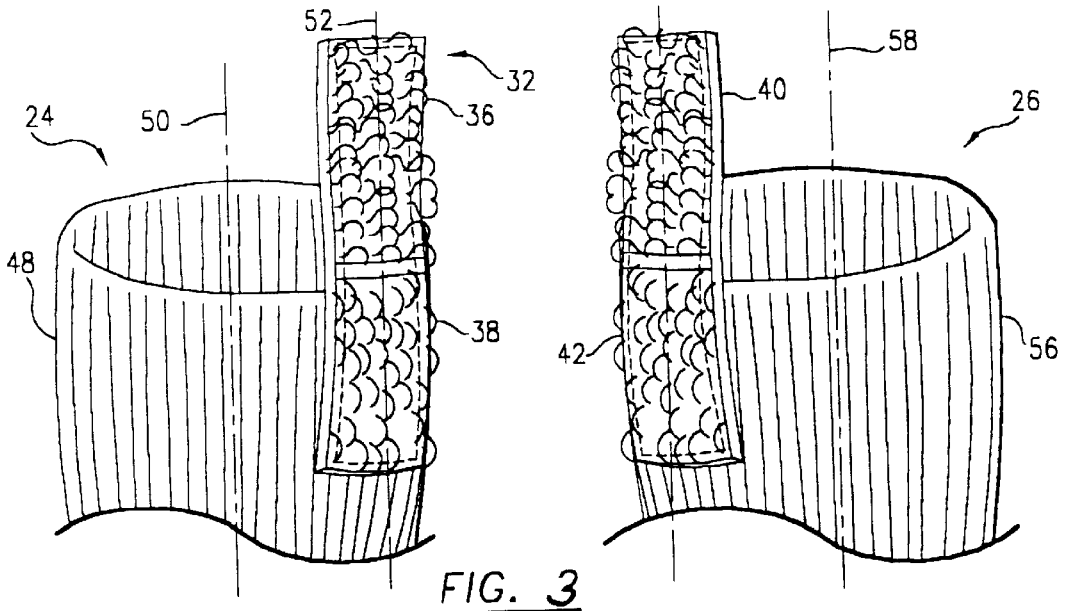
FIG. 3 is an enlarged view of the top of the leg portion of the socks depicted in FIG. 2, with the socks separated from one another.

An important aspect of this invention involves the particular orientation of each tab 32 and 34 on the socks 24, 26, respectively. As best seen in FIGS. 2 and 3, the sock 24 includes a foot portion 46 and a leg portion 48 having a longitudinal axis 50. The tab 32 is affixed to the leg portion 48 of sock 24 such that the longitudinal axis 52 of tab 32 is substantially parallel to the longitudinal axis 50 of the leg portion 48 of sock 24. Similarly, the sock 26 includes a foot portion 54 and a leg portion 56 having a longitudinal axis 58. The tab 32 is affixed to the leg portion 56 of sock 26 such that the longitudinal axis 60 of tab 34 is substantially parallel to the longitudinal axis 58 of leg portion 56. Preferably, the section 38 of tab 32 carrying the loop fastening elements is mounted to sock 24, and the section 42 of tab 34 carrying the loop fastening elements is mounted to sock 26.

Figure 6:
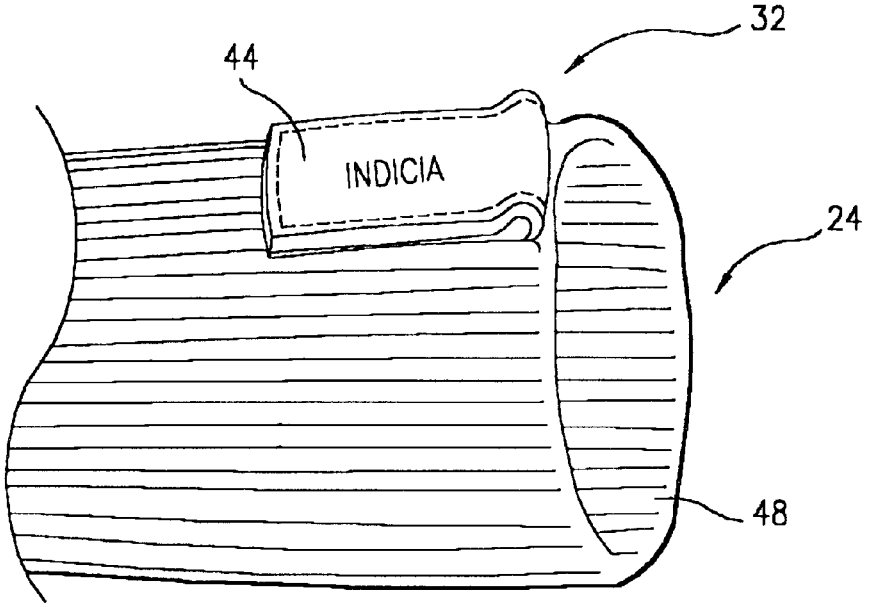
FIG. 6 is a view similar to FIG. 5 except with the tab in the closed position.

While the socks 24, 26 are being worn, each of the tabs 32, 34 is folded over upon itself, i.e., in the closed position depicted in FIG. 6. This reveals the indicia 44 on one surface of each tab 32, 34, and prevents exposure of the hook and loop fastening elements on the opposite surface. In order to prepare the socks 24, 26 for laundering, the tabs 32, 34 are first moved to the open position shown in FIG. 2. The tabs 32, 34 are then interconnected with one another such that the hook fastening elements on section 36 of tab 32 engage the loop fastening elements on section 42 of tab 34, and the hook fastening elements on section 40 of tab 34 engage the loop fastening elements on section 38 of tab 32. With the tabs 32, 34 interconnected in this orientation, the socks 24 and 26 are positioned essentially end-to-end, or in abutting relationship with one another, as best seen in FIGS. 2 and 4.

Figure 4:
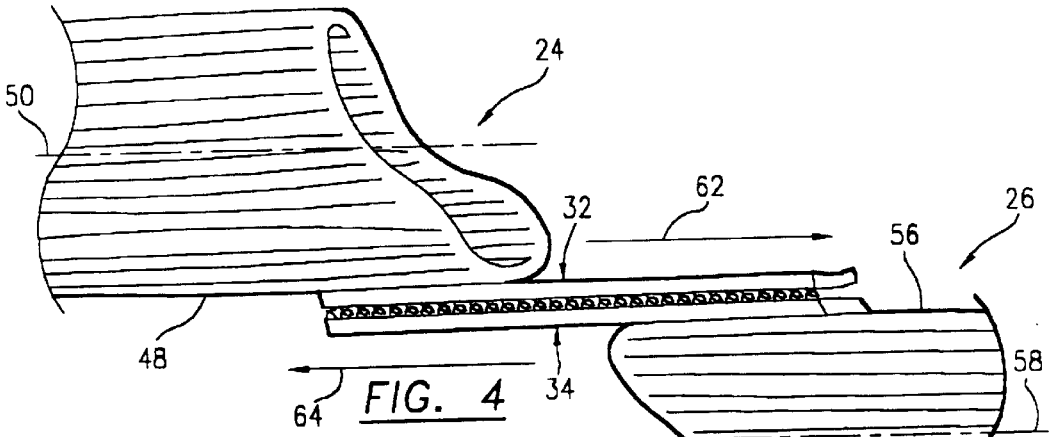
FIG. 4 is a view similar to FIG. 3 except with the tabs in the engaged position.

It has been found that the hook and loop fastening elements of tabs 32 and 34 exhibit much more resistance to separation in response to forces acting in shear, i.e., in a direction substantially parallel thereto as schematically depicted by the arrows 62 and 64 shown in FIG. 4, compared to forces acting perpendicular or normal to such fastening elements. That is, separation of the interconnected hook and loop fastening elements of tabs 32, 34 is much more difficult when forces tending to separate them are caused to act parallel to or along their longitudinal axes as distinguished from forces applied perpendicular thereto. During both washing and drying of the socks 24, 26 in the laundering process, the socks 24, 26 tend to pull apart from one another and separate. These pulling or separation forces, in turn, are directly transferred to the interconnected tabs 32, 34. With the tabs 32, 34 in the orientation depicted in FIGS. 2 and 4, such forces are caused to act in shear or generally parallel to the plane of the interconnected tabs 32, 34 and along their longitudinal axes 52, 60, respectively. As a result, separation of the socks 24, 26 is substantially eliminated.

This is in contrast to the construction found in the Boxer et al. U.S. Pat. No. 4,165,555 shown in FIG. 1. As mentioned above, the Boxer et al. tabs or patches are affixed to the socks such that the longitudinal axis of each tab 10 and 12 is substantially perpendicular to the longitudinal axis 18 and 20 of the respective sock. As a result, forces tending to separate the socks are caused to act generally perpendicularly to the patches 10 and 12, and, in turn, perpendicular to their interconnected hook and loop fastening elements. In response to the imposition of a force acting perpendicularly thereto, the hook and loop fastening elements of patches or tabs 10 and 12 readily disengage from one another and are incapable of withstanding the separation forces imposed on the socks during the laundering process.

Figure 5:
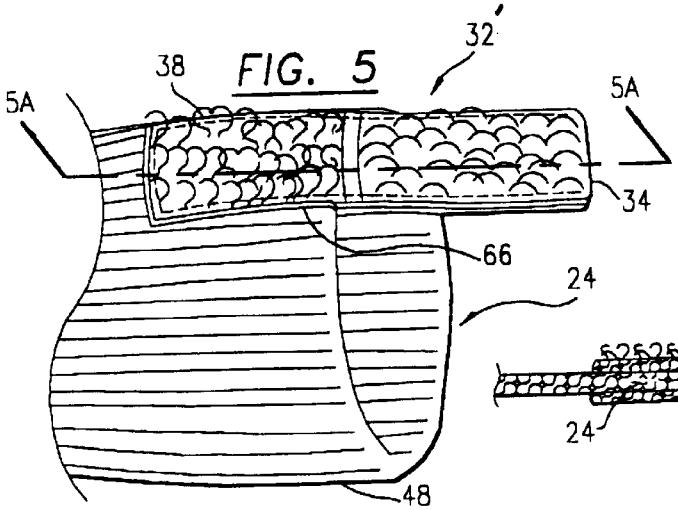
FIG. 5 is a view of a top portion of a sock in which a tab is recessed into the leg portion.
Figure 5A:
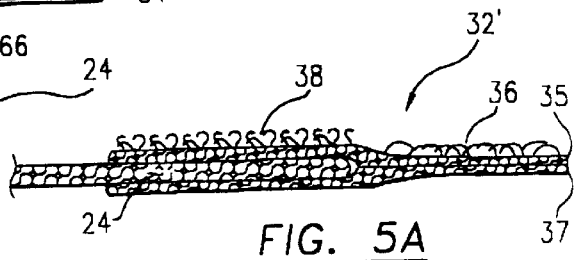

In one presently preferred embodiment of this invention, each tab 32 and 34 is stitched or otherwise permanently affixed to the outside of a respective leg portion 48 and 56 of socks 24, 26. The tabs 32, 34 are formed of a single strip of cloth material, such as cotton twill or other comparatively soft and moisture absorbent material. An alternative embodiment is shown in FIGS. 5 and 5A in which a tab 32' is formed of two strips 35 and 37 of cloth material. The strips 35, 37 are affixed to one another, such as by sewing or the like along section 36. As best seen in FIG. 5A, the strips 35, 37 arc separated at section 38 so that part of the leg portion 48 of sock 24 can be sandwiched therebetween, and then the strips 35, 37 are sewn to the sock with the stitches passing through both strips 35, 37 and the sock. If desired, a portion of the sock between the strips 35, 37 can be cut away to allow the sections 36, 38 of tab 32' to appear substantially flush with the outside of the sock when the mating hook and loop fastening elements carried thereon engage one another.

Additionally, the size and shape of each tab 32 and 34 can be varied depending upon the relative size of the socks to which they are affixed. In the presently preferred embodiment, the tabs 32, 34 are generally rectangular in shape although it is contemplated that other shapes such as square, round, oval etc., could be employed. Using rectangular-shaped tabs, a youth or child-size sock receives a tab 32 having a width of about one-half inch, and an overall length of one and one-half inches with each section 36 and 38 having an individual length of three-quarters of an inch. A normal size adult sock receivers a tab 32 having a width of about three-quarters of an inch, with each section 36, 38 being about one inch in length for a total overall length of two inches. A tab 32 for large size adult socks has a width of about one inch and an overall length of three inches with each section 36, 38 being individually one and one-half inches in length. The tab 34 is formed with identical dimensions. Additionally, the hook and loop fastening elements carried by each tab 32 and 34 are of the same type currently commercially available such as disclosed, for example, in U.S. Pat. Nos. 3,000,384 and 3,009,235.

Figure 7:
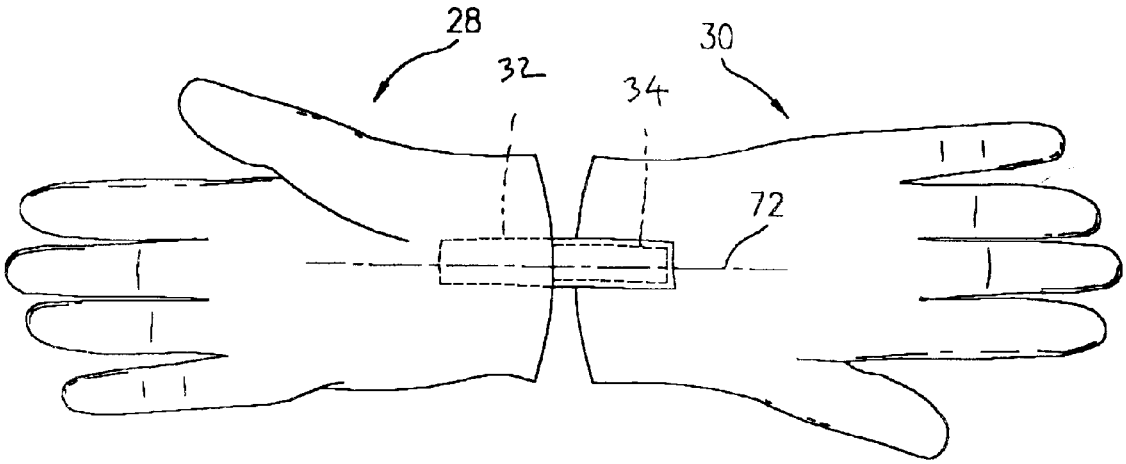
FIG. 7 is a perspective view of a pair of gloves having the tabs of the attachment device of this invention.

With reference to FIG. 7, a pair of gloves 28 and 30 are shown including tabs 32 and 34, respectively, which are identical to those described above. The tab 32 is mounted to glove 28 such that its longitudinal axis 52 is substantially parallel to the longitudinal axis 72 of glove 28. Similarly, the tab 34 is mounted to glove 30 such that its longitudinal axis 60 is substantially parallel to the longitudinal axis 74 of glove 30. The same resistance to separation of gloves 28, 30 during laundering is achieved with this orientation of tabs 32, 34 thereon as described in detail above in connection with socks 24, 26.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof.

For example, in the Figs., the tabs 32 and 34 are mounted to socks 24, 26 such that the sections 38 and 42 carrying the loop fastening elements are secured to the leg portions 48 and 56, respectively. It is contemplated that the orientation of the tabs 32, 34 could be reversed such that the hook fastening elements carried by sections 36 and 40 could be mounted to respective leg portions 48 and 56. Additionally, the tabs 32 and 34 are shown in FIG. 2 as being mounted to the "back" side of socks 24 and 26, i.e., on the same side of the sock as the heel portion thereof. The tabs 32, 34 could be mounted to essentially any location along the leg portions 48, 56 of socks 24, 26, e.g., along the side portions thereof or others, and still be considered within the scope of this invention.

Therefore, it is intended that the invention not be limited to the particular embodiment disclosed as the best mode contemplated for carrying out this invention, but the invention will include all embodiments falling within the scope of the appended claims.

I claim:

1. A pair of socks, comprising:

a first sock and a second sock each having a leg portion and a foot portion;

an attachment device for releasably securing said first sock to said second sock, including:

(i) a first tab including a first section connected to said leg portion of said first sock and an adjacent, second section foldable between a closed position in contact with said first section and an open position apart from said first section, one of said first and second sections carrying hook fastening elements and the other carrying mating loop fastening elements;

(ii) a second tab including a third section connected to said leg portion of said second sock and an adjacent, fourth section foldable between a closed position in contact with said third section and an open position apart from said third section, one of said third and fourth sections carrying hook fastening elements and the other carrying mating loop fastening elements;

(iii) said first and second tabs being connected to respective first and second sock in an orientation wherein said hook and loop fastening elements of said first tabs engage and releasably connect to said hook and loop fastening elements of said second tabs with said first and second tabs in said open position such that forces tending to separate said first and second socks are caused to act along a plane substantially parallel to said connected tabs.

2. The socks of claim 1 in which the leg portion of each of the first and second socks has a longitudinal axis and said first and second tabs each have a longitudinal axis, said first and second tabs being mounted to respective first and second socks so that the longitudinal axis of said first and second tabs is substantially parallel to the longitudinal axis of the respective leg portion of the socks.

3. The socks of claim 1 in which said first section of said first tab and said third section of said second tab each carry the same one of said hook and loop fastening elements.

4. The socks of claim 1 in which said first tab and said second tab are interconnected in said open positions thereof so that forces acting on said first and second socks tending to separate said first and second tabs is caused to act in shear.

5. The socks of claim 1 in which each of said first and second tabs comprises a strip of material having opposed surfaces, one of said surfaces carrying said hook and loop fastening elements and the opposed surface being marked with an indicia.

6. The socks of claim 1 in which each of said first and second tabs are formed of two strips of material, said strips of material being affixed to one another along said second section of said first tab and along said fourth section of said second tab, said leg portion of said first sock being sandwiched between said strips of material and affixed to both of said strips along said first section of said first tab, said leg portion of said second sock being sandwiched between said strips of material and affixed to both of said strips along said third section of said second tab.

7. A pair of socks comprising:

a first sock and a second sock, each of said first and second socks including a foot portion and a leg portion having a longitudinal axis;

an attachment device for releasably securing said first sock to said second sock, including:

(i) a first tab including a first section connected to said leg portion of said first sock and an adjacent, second section foldable between a closed position in contact with said first section and an open position apart from said first section, one of such first and second sections carrying hook fastening elements and the other carrying mating loop fastening elements;

(ii) a second tab including a third section connected to said leg portion of said second lock and an adjacent, fourth section foldable between a closed position in contact with said third section and an open position apart from said third section, one of said third and fourth sections carrying hook fastening elements and the other carrying mating loop fastening elements;

(iii) said first and second tabs each having a longitudinal axis and being connected to respective first and second socks such that said longitudinal axis of each of said first and second tabs is substantially parallel to said longitudinal axis of the leg portion of a respective first and second sock, said hook and loop fastening elements of said first tab being releasably connected to said hook and loop fastening elements of said second tab in an orientation such that forces tending to separate said first and second socks result in the application of a shear force to said connected tabs.

8. The socks of claim 7 in which said first section of said first tab and said third section of said second tab each carry the same one of said hook and loop fastening elements.

9. The socks of claim 7 in which each of said first and second tabs comprises a strip of material having opposed surfaces, one of said surfaces carrying said hook and loop fastening elements and the opposed surface being marked with an indicia.

10. A pair of socks comprising:

a first sock including a foot portion and a leg portion having a longitudinal axis, a first tab including a first section connected to the leg portion of said first sock and an adjacent, second section foldable between a closed position in contact with said first section and an open position apart from said first section, one of said first and second sections carrying hook fastening elements and the other carrying mating loop fastening elements;

a second sock including a foot portion and a leg portion having a longitudinal axis, a second tab including a third section connected to the leg portion of said second sock and an adjacent, fourth section foldable between a closed position in contact with said third section and an open position apart from said third section, one of said third and fourth sections carrying hook fastening elements and the other carrying mating loop fastening elements;

said first and second tabs each having a longitudinal axis and being connected to respective first and second socks such that the longitudinal axis of each of said first and second tabs is substantially parallel to the longitudinal axis of the leg portion of a respective first and second sock, said hook and loop fastening elements of said first tab being releasably connected to said hook and loop fastening elements of said second tab in an orientation such that forces tending to separate the first and second socks result in the application of a shear force to said connected tabs.

11. The socks of claim 10 in which said leg portion of each of said first and second socks has an outside surface, said first and second tabs being mounted on said outside surface of said leg portion of respective first and second socks.

12. The socks of claim 10 in which said first section of said first tab and said third section of said second tab each carry the same one of said hook and loop fastening elements.

13. The socks of claim 10 in which each of said first and second tabs comprises a strip of material having opposed surfaces, one of said surfaces carrying said hook and loop fastening elements and the opposed surface being marked with an indicia.

14. The socks of claim 10 in which each of said first and second tabs are formed of two strips of material, said strips of material being affixed to one another along said second section of said first tab and along said fourth section of said second tab, said leg portion of said first sock being sandwiched between said strips of material and affixed to both of said strips along said first section of said first tab, said leg portion of said second sock being sandwiched between said strips of material and affixed to both of said strips along said third section of said second tab.

15. A pair of clothing items, comprising:

a first clothing item and a second clothing item;

an attachment device for releasably connecting said first and second clothing items, including:

(i) a first tab including a first section connected to said first clothing item and an adjacent, second section, foldable between a closed position in contact with said first section and an open position apart from said first section, one of said first and second sections carrying hook fastening elements and the other carrying mating loop fastening elements;

(ii) a second tab including a third section connected to said second clothing item and an adjacent, fourth section foldable between a closed position in contact with said third section and an open position apart from said third section, one of said third and fourth sections carrying hook fastening elements and the other carrying mating loop fattening elements;

(iii) said first and second tabs being connected to respective first and second clothing items in an orientation wherein said hook and loop fastening elements of said first tabs engage and releasably connect to said hook and loop fastening elements of said second tabs with such first and second tabs in said open position such that forces tending to separate the first and second clothing items are caused to act along a plane substantially parallel to said connected tabs.

16. The clothing items of claim 15 in which said first and second clothing items are a pair of socks.

17. The clothing items of claim 15 in which said first and second clothing items are a pair of gloves.

18. The clothing items of claim 15 in which said first section of said first tab and said third section of said second tab each carry the same one of said hook and loop fastening elements.

19. The clothing items of claim 15 in which said first tab and said second tab are interconnected in said open position thereof so that forces acting on said clothing items tending to separate said first and second tabs is caused to act in shear.

20. The clothing items of claim 15 in which each of said first and second tabs is formed of two strips of material, said strips of material being affixed to one another along said second section of said first tab and along said fourth section of said second tab, a portion of said first clothing item being sandwiched between said strips of material and affixed to both of said strips along said first section of said first tab, a portion of said second clothing item being sandwiched between said strips of material and affixed to both of said strips along said third section of said second tab.

* * * * *